United States Patent [19]

Lowe

[11] 4,267,868

[45] May 19, 1981

[54] COMPRESSIBLE STUFF SACK

[75] Inventor: Michael R. Lowe, Eldorado Springs, Colo.

[73] Assignee: Lowe Alpine Systems, Inc., Lafayette, Colo.

[21] Appl. No.: 89,326

[22] Filed: Oct. 29, 1979

[51] Int. Cl.[3] ..... B65D 33/00

[52] U.S. Cl. ..... 150/11; 150/1; 190/44

[58] Field of Search ..... 150/1, 11; 190/44

[56] References Cited

U.S. PATENT DOCUMENTS

| | | | |
|---|---|---|---|
| 61,467 | 1/1867 | Rose | 190/44 |
| 1,200,344 | 10/1916 | Hanan | 190/44 |
| 1,510,815 | 10/1924 | Adams | 190/44 X |
| 1,712,448 | 5/1929 | Eckhardt | 190/44 |
| 1,830,014 | 11/1931 | Brady | 150/11 X |
| 2,020,556 | 11/1935 | Kirkpatrick | 150/1 X |

FOREIGN PATENT DOCUMENTS

| | | | |
|---|---|---|---|
| 1557297 | 1/1969 | France | 190/44 |

*Primary Examiner*—Donald F. Norton

*Attorney, Agent, or Firm*—O'Rourke & Harris

[57] ABSTRACT

A sack for enclosing and compressing resilient materials, such as clothing items and sleeping bags having high air content filling, i.e., down filled matter or synthetics incorporating air voids, in the form of a stuff sack having a plurality of longitudinally extending adjustable length straps attached to the sack at opposed ends thereof and equidistantly spaced around the circumference of the sack, such that when the sack is "stuffed" in a conventional manner, substantial additional longitudinal force may be applied either by the straps or externally, and the straps shorten to telescope the sack into a compressed and stable configuration.

10 Claims, 4 Drawing Figures

COMPRESSIBLE STUFF SACK

BACKGROUND OF THE INVENTION

The present invention relates generally to stuff sacks for compactly containing compressible equipment and articles of clothing for storage and/or transport, and more specifically relates to an elongated stuff sack having a plurality of elongated adjustable length strap members attached to the sack at adjacent ends thereof, the straps being substantially equidistantly spaced around the periphery of the sack. Tension applied to the straps by, for instance, pulling the straps incremently through buckles, will induce and maintain telescoping and compression of the sack in a direction parallel to the straps beyond the already substantial compression normally obtained by stuffing compressible material into the sack.

Description of the Prior Art

Stuff sacks have been known and employed for many years. In a number of pursuits requiring an individual to store or physically transport gear for survival or comfort, various lightweight, thermally efficient constructions have evolved. Typical of these are down filled sleeping bags, and coats, parkas, sweaters, etc. More recently, and largely as a result of the decline in availability of quality down and the escalation of the cost therefore, synthetic material having a thermal efficiency and weight substantially equivalent to that of down have been produced. However, such synthetic materials, while resilient, tend to be more resistant to compression than down, and thus more difficult to compress into a small volume.

In general, a conventional stuff sack is of a volume defined by a substantially inelastic pliable material such that a particular item or group of items may be stuffed therein in a compressed mode. However, since the insertion of the articles into the stuff sack must be accomplished through an opening therein, and since the articles are almost universally resilient, only limited, though substantial, compression of the article may be obtained before the resiliency of the article defeats attempts to urge more of an article into a fixed volume. In essence, the articles rebound and tend to grow out of the stuff sack at about the same rate that an individual can insert the articles therein. When such an equilibrium is reached, the articles are still capable of substantially greater compression.

As a practical matter, no matter what the nominal sewn cross-section of a stuff sack, the tension induced therein by the compressed articles tends to form a circular cross-section, which of course is the minimal perimeter for a particular area. Attempts have been made to further reduce the volume of hand filled stuff sacks by tying laces or belts around the circumference of the sack and cinching these to a smaller diameter. In general, this has been of limited help in that the material constricted at one place merely bulges in another. Also, attempts have been made to lace a constricting corset, either integral with the sack or independently applied thereto. Again, only limited success has been attained in this manner.

In Summary, it is known to stuff compressible articles in a stuff sack to obtain limited compression and thus reduce the volume for storage or transport, by, for instance, hikers, climbers, bicyclists, and others desirous of carrying compressible items, and particularly compressible items of clothing and sleeping gear in an efficient manner. However, the degree of compression heretofore attainable has been moderate.

SUMMARY OF THE INVENTION

The instant invention, which provides a heretofore unavailable improvement over previous stuff sack arrangements, comprises a substantially conventional stuff sack having an opening at one portion usually an end, and means to close the opening. Conventional stuff sacks tend to be of circular cross-section and somewhat elongated, and are thus functionally cylindrical in shape. However, other shapes, i.e., pear shape, etc., are known. In any event, the instant invention provides as modification to an essential conventional stuff sack, a plurality of strap members attached to the sack at positions adjacent opposite ends, and preferably extending in an elongated direction of the sack. Buckles, or other such means are provided to facilitate adjustment of the length of the strap. The straps are equidistantly positioned around the periphery of the sack. While three or four straps are preferred, operably the invention is functional with as few as two straps, and as many as can be physically fitted around the sack. In operation, the sack is first stuffed with compressible articles in a conventional manner. When hand stuffing of the sack reaches its limits, the opening is securely closed and force is applied along the longitudinal of the sacks. This may be accomplished by cinching a drawstring, by pushing or sitting on the end of the sack, or both. Since the articles in the sack are seldom fully compressed as a result of hand stuffing, the sack compresses or telescopes along its axis parallel to the straps and is secured in the compressed position by the straps, which are suitably shortened as the sack is compressed.

Accordingly, an object of the present invention is to provide a new and improved stuff sack which provides for convenient, thorough compression of articles carried therein.

Another object of the present invention is to provide a new and improved stuff sack which enables even an individual of moderate strength to fully compress articles, such as sleeping bags and parkas, contained within the sack.

Yet another object of the present invention is to provide a new and improved telescoping stuffed sack which is simple and conveniently constructed while maintaining low weight.

These and other objects and features will become apparent from the following description.

DETAILED DESCRIPTION OF THE PREFERRED EMBODIMENT

Figure 1:
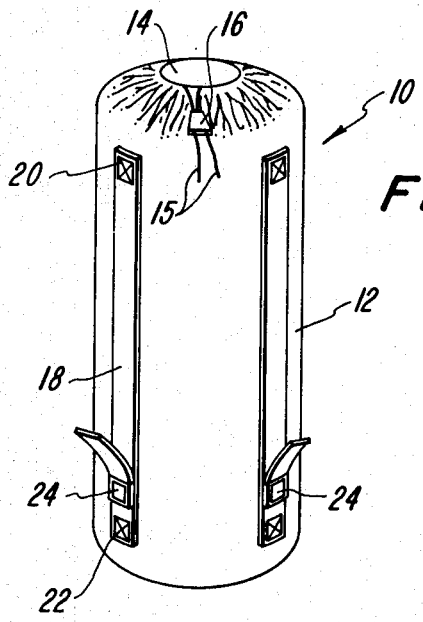
FIG. 1 is a perspective view of a stuff sack in accord with the instant invention illustrated prior to extraordinary compression of the sack and contents.
Figure 2:
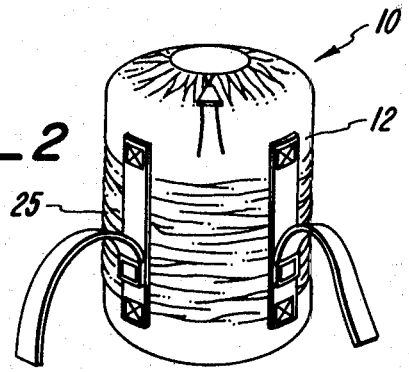
FIG. 2 is a view similar to that of FIG. 1 illustrating the stuff sack in compressed configuration.

Referring now to the drawings, wherein like components are designated by like reference numerals throughout the various figures, a stuff sack with telescoping compression means is shown in FIGS. 1 through 4 and generally designated by reference numeral 10. Stuff sack 10 includes bag member 12 which is of conventional construction, preferably circular in cross-section, and of a pliable material, such as nylon. Opening 14 is defined at one end of bag 12, and includes a drawstring 15 and clasp 16 to enable opening 14 to be securely closed. A plurality of straps 18 are disposed substantially parallel to a longitudinal axis of bag 12, and attached adjacent one end of bag 12, i.e., adjacent opening 14, at attachment points 20, and at the opposite end at attachment points 22. Straps 18 should be attached to bag 12 closer to the ends thereof than to the center of bag 12. Buckles 24 are provided to facilitate adjustment of the length of strap 18. Thus, as shown in FIG. 1, bag 12 may be tautly filled with items (not shown) until no more can be conveniently inserted through opening 14. Thereupon, string 15 is pulled to close opening 14 and secured by clasp 16. Then, a force may be applied longitudinally on bag 12 while concurrently shortening straps 18. Telescoped portion 25, as shown in FIG. 2, thus results thereby affording powerful and positive compression of bag 12.

Figure 3:
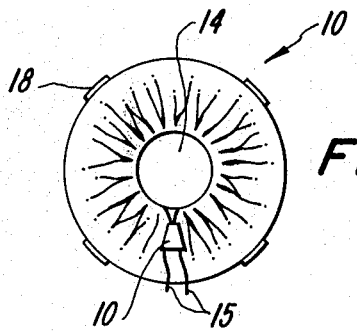
FIG. 3 is a top view of a stuff sack in accord with the instant invention.
Figure 4:
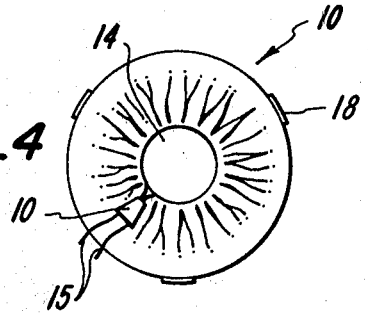
FIG. 4 is a view similar to that of FIG. 3 of another embodiment of the instant invention.

As shown in FIG. 3, straps 18 may be positioned every 90° around the circumference on bag 12. Alternatively, as shown in FIG. 4, straps may be positioned every 120° around the periphery of bag 12. It is preferred that straps 18, whatever the number thereof, be substantially equidistantly spaced around the periphery of bag 12 to induce a balanced compression at telescoped portion 25.

From the above description, it is apparent that a stuff sack which would be deemed "full" upon hand stuffing can be substantially reduced in volume by the powerful, positive tension induced by the straps. In one instance, a stuff sack filled as fully as readily convenient by hand stuffing a sleeping bag thereon, was easily compressed yet another forty percent in volume as a result of merely sitting on the end of the sack and tightening the straps.

While the structure of the stuff sack of the instant invention is advantageous in that it is simple, lightweight and foolproof, the method of operation is substantially different from the prior corsetting or tiestraps extending circumferentially around the sack. It is readily seen that the stuff sack is of a predetermined cross-section and cannot be further expanded in such direction. Rather than attempting to compress the sack by overcoming the cross-sectional radial tension thereon, the mechanism of the instant invention maintains tension throughout the sack by, in effect, pulling on opposed ends in a powerful manner. Since the sack cannot expand cross-sectionally, and since the ends are moved towards one another, the items in the sack are readily compressed. The telescoped section of the sack, though not in tension longitudinally, is in tension cross-sectionally. With the sack providing cross-sectional tension, and the straps in conjunction with the sack end portions providing longitudinal tension, the contents are constricted in every direction. In this manner, a more effective and complete compression of articles is accomplished.

Various features of the sack may be rearranged if desired. Though the opening is illustrated in the end of the sack, a side opening would also be operable. Since the greater portion of the compression as a result of the straps is in a direction substantially parallel to the average direction of the straps, it is desirable to utilize a bag elongated in the direction in which the straps extend to provide a balanced final configuration. However, other relative proportions are also operable. Also, the term strap as used herein is intended to include cords, strings, and similar securing means. Thus the invention contemplates a single cord attached to the ends of the stuff sack in a drum lacing fashion with each length constituting a "strap" as used in the above description and following claims.

Although only limited embodiments of the present invention have been illustrated and described, it is anticipated that various changes and modifications will be apparent to those skilled in the art, and that such changes may be made without departing from the scope of the invention as defined by the following claims.

What is claimed is:

1. A compressible stuff sack comprising:

a bag having opposite ends and of pliable material adapted to substantially assume a circular cross-section between the opposite ends;

an opening defined in the bag;

means to close the opening;

a plurality of spaced straps each of which is fixedly attached to the bag at two positions one each of which is adjacent an opposite end of the bag; and means to vary the length of each strap between the attachment points of the strap to the bag;

whereby, after filling the pliable bag with compressible items, the opening may be closed and additional compressive forces maintained by shortening the straps between the attachment points at the opposite ends of the bag.

2. A compressible stuff sack as set forth in claim 1 in which the bag of pliable material is of a substantially circular cross-section over a substantial portion of its length between the opposite ends of the bag and elongated in a direction perpendicular to the circular cross-section and between the opposite ends with the straps extending substantially parallel to the elongated dimension of the bag.

3. A compressible stuff sack as set forth in claim 2 in which the opening is circular and defined at an end of the bag adjacent the attachment points of the straps.

4. A compressible stuff sack as set forth in claim 3 in which the means to close the opening comprise a drawstring extending through the bag adjacent the opening and includes a clasp member to secure the drawstring.

5. A compressible stuff sack as set forth in claim 1 in which at least three straps are attached to the bag.

6. A compressible stuff sack as set forth in claim 5 in which four straps are attached to the bag.

7. A compressible stuff sack as set forth in claim 1 which the means to vary the length of the straps are buckle members through which the straps extend.

8. A compressible stuff sack comprising:

a bag of pliable material having a circular central cross-section and elongated in the direction perpendicular to the plane of the circular cross-section between opposite ends of the bag;

an opening defined at an end of the bag in the elongated direction;

means to close the opening;

a plurality of straps extending substantially in the elongated direction of the bag with each strap fixedly attached to the bag at spaced positions one each of which is adjacent an opposite end of the bag; and means operably connected to each strap to vary the length of the strap between the strap attachment positions and secure the strap at a preselected length between such positions.

9. A compressible stuff sack as set forth in claim 8 in which the straps are equidistantly positioned around the circular perimeter of the bag.

10. A compressible stuff sack as set forth in claim 8 in which three substantially parallel straps are attached to the bag.

* * * * *